United States Patent [19]

Yavnieli

[11] 4,344,776

[45] Aug. 17, 1982

[54] ELECTROSTATIC AIR FILTER

[75] Inventor: Mordechai Yavnieli, Ramat-Hasharon, Israel

[73] Assignee: AMCOR Ltd., Tel Aviv, Israel

[21] Appl. No.: 264,610

[22] Filed: May 18, 1981

Related U.S. Application Data

[63] Continuation of Ser. No. 137,561, Apr. 4, 1980, abandoned.

[30] Foreign Application Priority Data

Jun. 27, 1979 [IL] Israel ..... 57677

[51] Int. Cl.[3] ..... B03C 3/12; B03C 3/32

[52] U.S. Cl. ..... 55/129; 55/152; 55/279; 422/121

[58] Field of Search ..... 55/102, 124, 130, 131, 55/138, 154, 279, 128, 129, 152; 422/121

[56] References Cited

U.S. PATENT DOCUMENTS

| | | | |
|---|---|---|---|
| 2,973,054 | 2/1961 | Kurtz | 55/131 |
| 3,053,028 | 9/1962 | Kayko | 55/132 |
| 3,421,291 | 1/1969 | Messen-Jaschin | 55/131 |
| 3,440,800 | 4/1969 | Messen-Jaschin | 55/131 |
| 3,798,879 | 3/1974 | Schmidt-Burbach et al. | 55/131 |
| 4,203,948 | 5/1980 | Brundbjerg | 55/102 |

FOREIGN PATENT DOCUMENTS

| | | | |
|---|---|---|---|
| 2742913 | 9/1978 | Fed. Rep. of Germany | 55/154 |
| 866764 | 9/1941 | France | 55/128 |
| 47-13477 | 11/1972 | Japan | 55/131 |

*Primary Examiner*—David L. Lacey

*Attorney, Agent, or Firm*—Browdy and Neimark

[57] ABSTRACT

An electrostatic air filter comprising a housing, an air inlet and an air outlet in the housing, air transfer means for transferring air from the inlet to the outlet through an airflow path, air ionizing means located in the air path for generating and introducing charged ions into the throughflowing air and a disposable, electrically conductive air filter mat located and replaceably supported adjacent the outlet.

5 Claims, 1 Drawing Figure

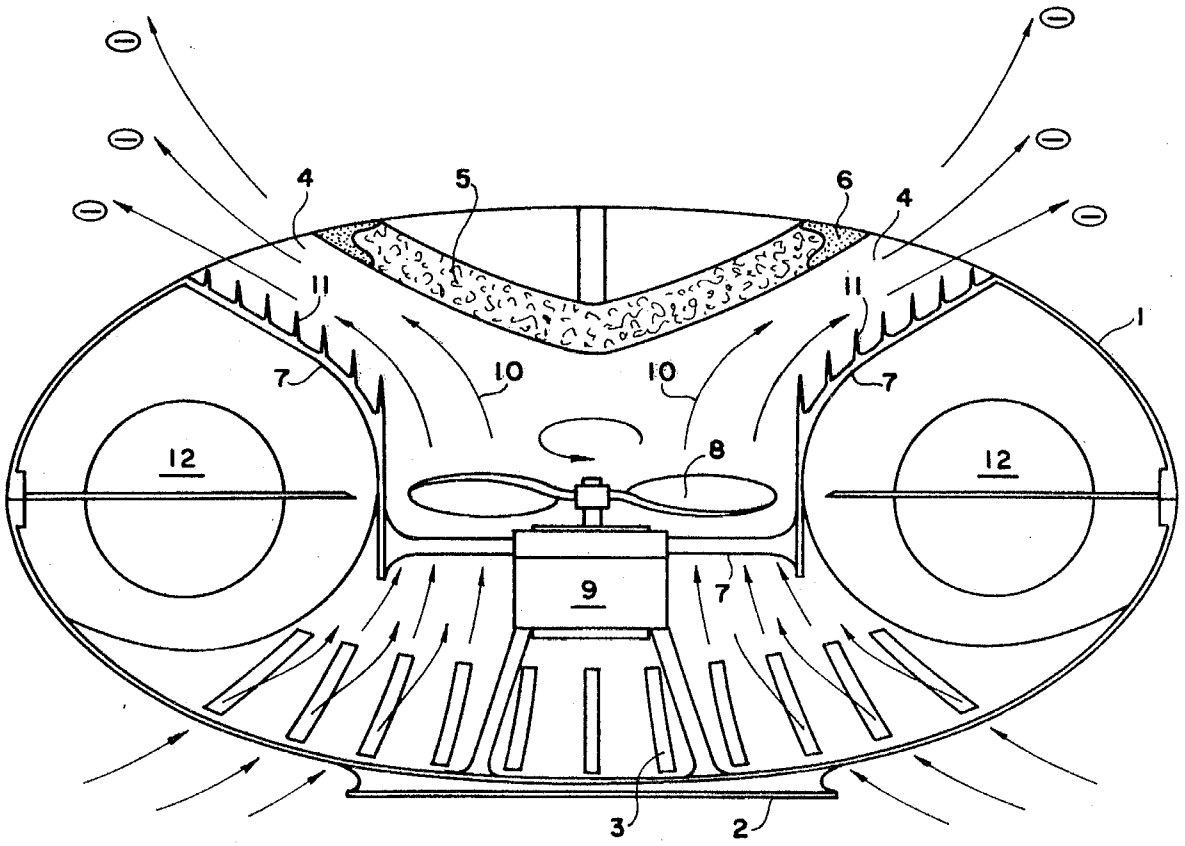
1
2
3
4
5
6
7
8
9
10
11
12
I

ELECTROSTATIC AIR FILTER

This application is a continuation of an application filed Apr. 4, 1980, Ser. No. 137,561, now abandoned.

This invention relates to an electrostatic air filter.

According to the present invention there is provided an electrostatic air filter comprising a housing, an air inlet and an air outlet in the housing, air transfer means for transferring air from the inlet to the outlet through an airflow path, air ionizing means located adjacent to the air path for generating and introducing charged ions into the throughflowing air and a disposable, electrically conductive air filter mat located and replaceably supported adjacent the airflow path, oppositely disposed to the air ionizing means and extending from the air transfer means almost to the outlet.

With such a filter the generated charged ions become attached to the particles in the throughflowing air and the thus charged particles are attracted to the electrically neutral or oppositely charged air filter mat on which they are deposited allowing the thus purified air to pass out of the air outlet. With known electrostatic air filter units of this kind there are formed adjacent the air outlet a plurality of fixed electrically conductive plates to which an opposite electric polarity is applied or which are maintained electrically neutral and the charged particles are caused to pass to these plates and to become deposited thereon. These plates require a relatively elaborate support structure and must regularly be cleaned so as to allow for the effective operation of the unit. In contradistinction to such known units, the unit in accordance with the present invention utilizes a disposable filter mat formed for example of steel wool or the like which requires minimal support structure and which, when clogged with the deposited air particles can be readily replaced.

BRIEF DESCRIPTION OF THE DRAWING

One embodiment of an electrostatic air filter unit in accordance with the present invention will now be described way of example and with reference to the accompanying drawings which is a schematic longitudinally sectioned view of such a unit.

GENERAL DESCRIPTION

As seen in the drawings the unit comprises a casing 1 having a support base 2 and, adjacent thereto a plurality of air inlets 3. Formed in the upper portion of the casing 1 is an annular air outlet 4 and supported adjacent thereto is a filter mat 5 formed of steel wool or the like supported by means of a frame structure 6 formed integrally with the casing 1.

Mounted on a support structure 7 within the casing 1 is a fan 8 driven by a motor 9 which serves to draw air in through the inlets 3 and to direct it along air flowpaths 10 so as to emerge out of the outlet 4. Mounted adjacent the air flowpaths 10 on the support structure 7 are electrode needles 11 which form part of ionizing units 12 and which serve to generate and inject ions into the air flowpaths 10.

In operation particles entrained in the throughflowing air become charged by the ions generated in the air flowpaths and these charged particles are attracted to the conductive filter mat 5 which is either provided with an oppositely directed potential or is maintained electrically earthed and in this way the particles become trapped in the mat 5 and relatively purified air emerges out of the outlet 4.

As shown in the drawing additional ionizing electrode needles can be placed just adjacent the outlet beyond the oppositely disposed mat so as to provide the purified outgoing air with beneficial positive ions.

As the filter mat 5 becomes clogged with deposited particles it can be readily replaced by a clean filter mat the old one being either washed or thrown away.

It will be readily seen that the electrostatic air filter unit just described is of economical size and construction and lends itself to effective and efficient use.

I claim:

1. An electrostatic air filter comprising:

a housing, air inlet means and air outlet means in the housing, wall means connecting said air inlet means and said air outlet means and defining an airflow path, said airflow path being substantially Y-shaped in vertical cross-section having a stem portion and a pair of diverging arms ascending from said stem portion, air transfer means located in the stem portion of said Y-shaped cross-section part of said air flow-path for causing air to flow through the housing from the inlet means to the outlet means along said airflow path, air ionizing means for generating and introducing charged ions into the throughflowing air, said air ionizing means located along a first side of each of said diverging arms, said air ionizing means comprising:

support structure attached along one side of the wall means defining said airflow path from said stem portion to said outlet means, electro needles extending from said support structure into said airflow path, a disposable, electrostatically chargeable air filter mat means located along a side opposite said first side of said diverging arms on said wall means spaced apart from and substantially oppositely disposed to said electro needles on a side opposite to the one side, the path for the ions being transverse to said airflow path, and said main airflow path being constructed and arranged such that through both of said divergent arms it is substantially clear of obstructions and extending in a straight line from said air transfer means to said outlet means without substantially intersecting either said air filter mat means or said electro needles so that said dust particles in said airflow path are ionized by ions produced by said needles and attracted to said oppositely charged air filter mat means as said air flows past said mat means from the air transfer means to the outlet means.

2. The electrostatic filter of claim 1 wherein said air filter mat means is replaceably supported in said housing, wherein said housing includes support means, and wherein said air inlet means is located on the same side of said housing as said support means.

3. The electrostatic filter of claim 2 wherein said outlet means is annularly shaped.

4. The electrostatic filter of claim 1 wherein said outlet means is annularly shaped and wherein said electro-needles extend along said outlet means beyond said air filter mat means for assuring that ionized air is supplied to the ambient atmosphere.

5. The electrostatic filter of claim 1 wherein said air filter mat means extends over most of the entire length of the side opposite said first side of the diverging arms.

* * * * *